US005427306A

United States Patent [19]

Petriekis et al.

[11] Patent Number: 5,427,306

[45] Date of Patent: Jun. 27, 1995

[54] REINFORCED BULK MATERIAL BOX

[75] Inventors: Paul F. Petriekis, Palos Park; Robert A. VanBeek, Paw Paw; Michael Wilford, Chicago; James Zavodsky, Schaumburg, all of Ill.

[73] Assignee: Packaging Systems, Inc., Westmont, Ill.

[21] Appl. No.: 935,846

[22] Filed: Aug. 26, 1992

Related U.S. Application Data

[63] Continuation-in-part of Ser. No. 694,837, May 2, 1991, Pat. No. 5,143,278.

[51] Int. Cl.[6] ..... B65D 5/34

[52] U.S. Cl. ..... 229/23 R; 220/465; 229/119; 229/242; 229/918; 493/84; 493/114; 493/162

[58] Field of Search ..... 229/117.12, 117.13, 229/117.16, 121, 122, 119, 164, 23 R, , 242, 243, 920, 918, DIG. 2, DIG. 5, DIG. 11; 220/462, 465; 493/84, 89, 114, 128, 162

[56] References Cited

U.S. PATENT DOCUMENTS

| | | | |
|---|---|---|---|
| 1,488,533 | 4/1924 | Flood | 229/122 |
| 2,145,181 | 1/1939 | Kennedy | 229/122 |
| 2,201,462 | 5/1940 | Wells et al. | 229/918 |
| 2,484,975 | 10/1949 | Van Saun | 229/143 |
| 2,788,933 | 4/1957 | Kessler | 229/117.16 |
| 3,090,526 | 5/1963 | Hamilton et al. | 220/465 |
| 3,099,379 | 7/1963 | Stease | 229/23 R |
| 3,208,658 | 9/1965 | Membrino | 220/462 |
| 3,253,764 | 5/1966 | Goetschius et al. | 220/465 |
| 3,342,401 | 9/1967 | Kitchell | 229/119 |
| 3,381,879 | 5/1968 | Belcher et al. | 229/119 |
| 3,670,949 | 6/1972 | Galanes | 229/117.16 |
| 3,863,831 | 2/1975 | Wozniacki et al. | 229/23 R |
| 3,899,123 | 8/1975 | Stollberg et al. | 229/DIG. 4 |
| 4,053,098 | 10/1977 | Baptist | 229/23 R |
| 4,805,765 | 2/1989 | Barrett et al. | 229/122 |
| 4,815,631 | 3/1989 | Eeg et al. | 220/462 |
| 4,946,091 | 8/1990 | Kupersmit | 229/23 R |
| 4,948,033 | 8/1990 | Halsell, Jr. et al. | 229/23 R |
| 4,992,068 | 2/1991 | Conrad | 229/122 |
| 5,000,320 | 3/1991 | Kuchenbecker | 229/122 |
| 5,143,278 | 9/1992 | Petreikis et al. | 229/242 |

FOREIGN PATENT DOCUMENTS

| | | | |
|---|---|---|---|
| 717847 | 9/1965 | Canada | 229/122 |
| 2240156 | 3/1975 | France | 229/DIG. 11 |
| 213138 | 8/1989 | Japan | 229/23 R |
| 1013 | 8/1906 | United Kingdom | 229/122 |

*Primary Examiner*—Gary E. Elkins

*Attorney, Agent, or Firm*—Wallenstein & Wagner, Ltd.

[57] ABSTRACT

Corrugated paper blanks for cooperatively forming a six wall box, and a box formed from the paper blanks are disclosed. The box formed from a body blank 10 and two side blanks 100 has two side walls, two end walls 32 and 36, a bottom wall 34, a top wall cooperatively formed by two top panels 30 and 38, a door 52 in one of the end walls 36, and a plurality of horizontally spaced perforations 74 between a distal end of the door 52 and the bottom wall 34 to minimize tears along the paperboard corrugations upon compression of the box. The box also has positioning slots 76 on one or both of its end walls 32 and 36 at opposite sides of the box to aid in moving the box while on a shelf or otherwise.

44 Claims, 3 Drawing Sheets

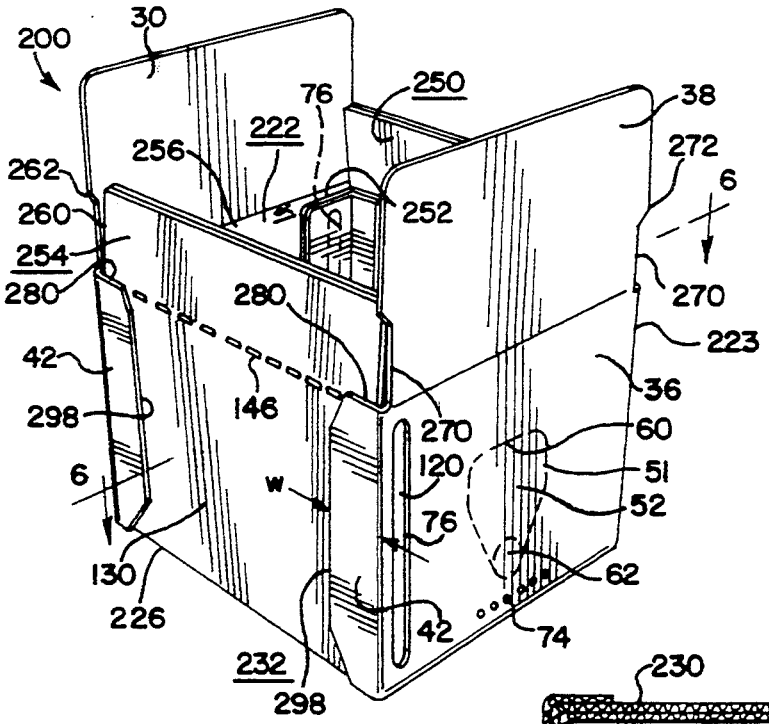
FIG.5
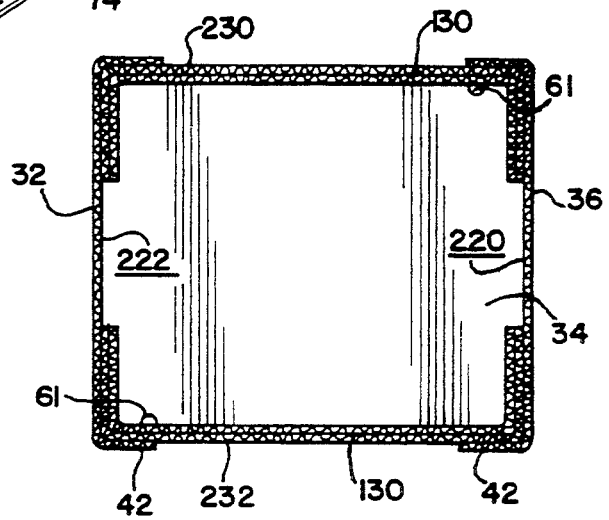
FIG. 6
FIG. 7
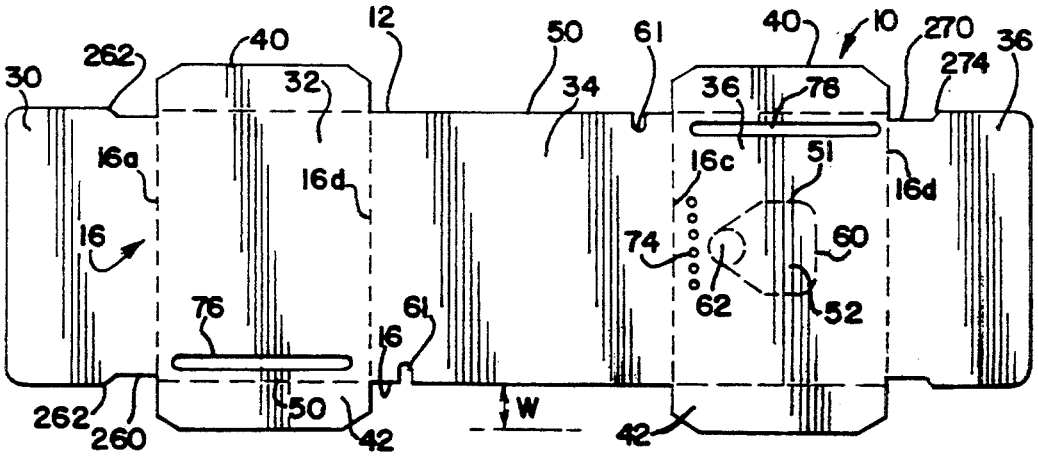

REINFORCED BULK MATERIAL BOX

RELATED APPLICATIONS

This is a CIP of Ser. No. 07/694,837 filed May 2, 1991, now U.S. Pat. No. 5,143,278 issued Sep. 1, 1992.

TECHNICAL FIELD

The present invention relates generally to bulk material containers and specifically to reinforced corrugated flatboard boxes for shipping bags of liquid.

BACKGROUND OF THE INVENTION

Soft drinks are sold throughout the United States and the entire World. Soft drinks may be packaged in cans, and bottles, and sold directly to the public or may be economically dispensed by pressurized soft drink dispensers and sold by the glass, pitcher, or cup. Soft drink dispensers use plastic tubing to connect a pressurized supply of refrigerated and carbonated water with a supply of soft drink syrup. The soft drink dispenser mixes the carbonated water with the soft drink syrup in the proper proportion, and dispenses the resulting carbonated soft drink through a dispensing head into an appropriate vessel.

Soft drink syrup may be distributed in five gallon plastic bags enclosed within a corrugated paper box. The bag usually has a spout dimensioned to accommodate the tubing system of the soft drink dispenser so that the contents of the bag may be dispensed from the bag.

Prior boxes that have been specially designed to enclose and transport these five gallon bags usually are six sided boxes folded from a single sheet of corrugated paper that is folded and glued along a single glue lap to an outside wall of the box. The boxes usually have bottom and top walls that are formed from the overlap of major and minor flaps, and the box usually folds flat for storage. The boxes also have a perforated section along an end wall that may be removed to accommodate the spout so that liquid may be removed from the bag without opening the top of the box.

However, these prior boxes have presented several problems to the distributors and the bottlers of the soft drink syrup. For example, distributors have discovered that these boxes have insufficient structural support and that movement of the liquid filled bag within the box may cause the box to unfold or breakdown during warehousing and distribution. Further, the boxes have inadequate stacking strength and may crush, or have its perforated spout break out or the box may otherwise be damaged under the weight of a palletized load. In more serious cases where the perforated spout breaks out a tear forms in a side or end panel of the box which follows the paperboard corrugations causing the box to rip open. In all cases, the box is rendered incapable of protecting the contents of the bag from outside hazards that may puncture the bag and release its contents.

Distributors had also had difficulty manipulating or moving individual boxes while stacked on shelves. Many prior boxes have flat walls with no protuberance or edge to grab a hold of to move the box.

The bottler has also encountered problems with this box. For example, the glue lap that was provided to hold prior boxes together, oftentimes became unglued during the loading of the box with a liquid filled bag causing the entire box to unfold. Further, the bottler has had difficulty in detecting leaks in these boxes until after the boxes have been filled and prepared for shipment or actually shipped. Bottlers have also had difficulty, in loading the prior boxes, to get the liquid filled bags to cover the entire bottom of the box for even weight distribution.

For these reasons, it is desirable to produce a more cost effective box for shipping five gallon liquid filled bags, that has greater stacking strength than boxes presently being used, that allows for immediate leak detection, that encourages the liquid filled bag to conform to the bottom wall of the box, that minimizes any rip that may occur in the box adjacent the door, and that has hand holds on the ends of the box for ease of handling.

SUMMARY OF THE INVENTION

The present invention provides a reinforced corrugated paper box and corrugated paper blanks for forming the box that may be used for the shipment of five gallon bags of liquid, and other bulk material.

According to the present invention, corrugated paper blanks are provided for cooperatively forming a six wall box. The blanks comprise an elongate body blank with opposed lateral sides, and two side blanks each having opposed lateral sides, and opposed top and bottom ends. Transverse fold lines extending between the opposed lateral sides of the body blank divide the body blank into a first, a second, a third, a fourth and a fifth panel. Body flanges extend from the opposed lateral sides of the body blank either from the second and fourth panel or the second, third and fourth panel. These body flanges attach the body blank to the side blanks. Positioning slots are cut from the second and/or the fourth panel along a lateral edge of the body blank for ease of handling.

The side blanks have side flanges extending from each of the opposed lateral sides of the side blank to attach to the body blank. Two side blanks are attached, one at each opposite lateral side of the body blank, to form a six wall box.

The box constructed from the body blank and the two side blanks comprises a top wall; a bottom wall having first and second lateral sides; opposed first and second end walls, each first and second end wall having inner and outer surfaces, and first and second lateral sides. The first and second end walls have body flanges extending from their first and second lateral sides. The box also includes opposed first and second side walls, each side wall having inner and outer surfaces, first and second lateral sides, and opposed top and bottom ends. The first and second side walls each have side flanges extending from their first and second lateral sides.

The side flanges extending from the first lateral side of each first and second side walls each attach to the first end wall. The side flanges extending from the second lateral side of each first and second side walls each attach to the second end wall. The body flanges extending from the first lateral side of the first and second end walls and the bottom wall each attach to the first side wall, and the body flanges extending from the second lateral side of the first and second end walls and the bottom wall each attach to the second end wall.

The body flanges and the side flanges provide substantial structural support to the box and greatly increases the stacking strength of the box.

Preferably, the box has one or two holes in the bottom wall of the box near a lateral side or at opposed lateral sides of the bottom wall. These holes allow for the passage of air and liquid. Consequently, when a filled five gallon bag is dropped into the box, air is displaced through the hole or holes allowing the contents of the bag to evenly distribute over the bottom wall of the box. Also, the holes allow for early leak detection by allowing liquid to pass out of the box immediately after the leak occurs.

The three piece construction of the present box, allows one to interchange the stock of material used to build the box. For example, the box builder could use a single ply corrugated paper for the body blank, and a double ply corrugated paper for the side blanks. The double ply corrugated paper side walls will add substantial structural support to the box.

It is desirable to provide a perforated door in the box that is hingeably connected to the box with a portion of the door being removable to accommodate a spout commonly used on five gallon bags for containing liquid. Preferably the perforations should be made in a central portion of an end wall where the walls are made of single ply corrugated paper rather than the side walls that are made of double ply corrugated paper. This will result in a box with maximum structural support.

In conjunction with the perforated door, the present box includes a plurality of horizontally spaced perforations provided between a bottom portion of the detachable door and the bottom wall to prevent tears adjacent the door from continuing along the paperboard corrugations of the end wall.

To enhance the ability of people to move the box while on a shelf or on the floor, a positioning slot is provided on one end wall or on two end walls at opposite corners.

The structure of the present box provides for a continuous bottom wall. This reduces the amount of stock needed to manufacture the box with the obvious decrease in cost. This makes it commercially attractive when one considers that thousands of these boxes are used each day.

BRIEF DESCRIPTION OF DRAWINGS

FIG. 5 is a perspective view of a second embodiment of the invention;

FIG. 6 is a top view of the box taken along line 6—6 of FIG. 5; and, FIG. 7 is a top view of an elongate body blank used to form the box in FIG. 5.

DETAILED DESCRIPTION

Figure 1:
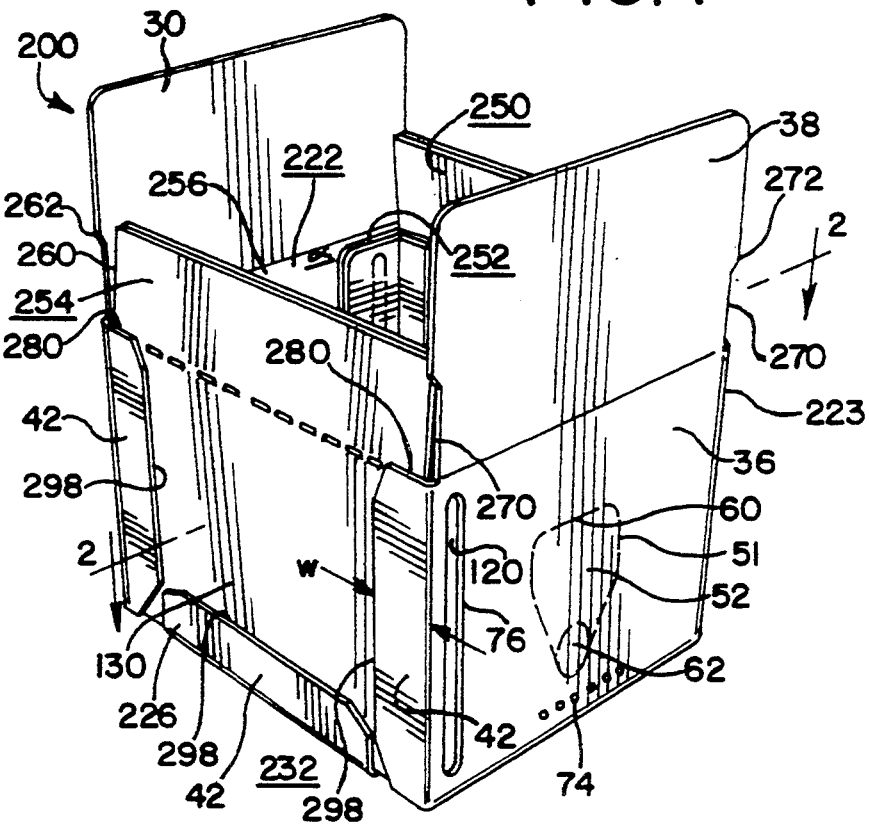
FIG. 1 is a perspective view of the present invention.

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the broad aspect of the invention to the embodiment illustrated.

Figure 3:
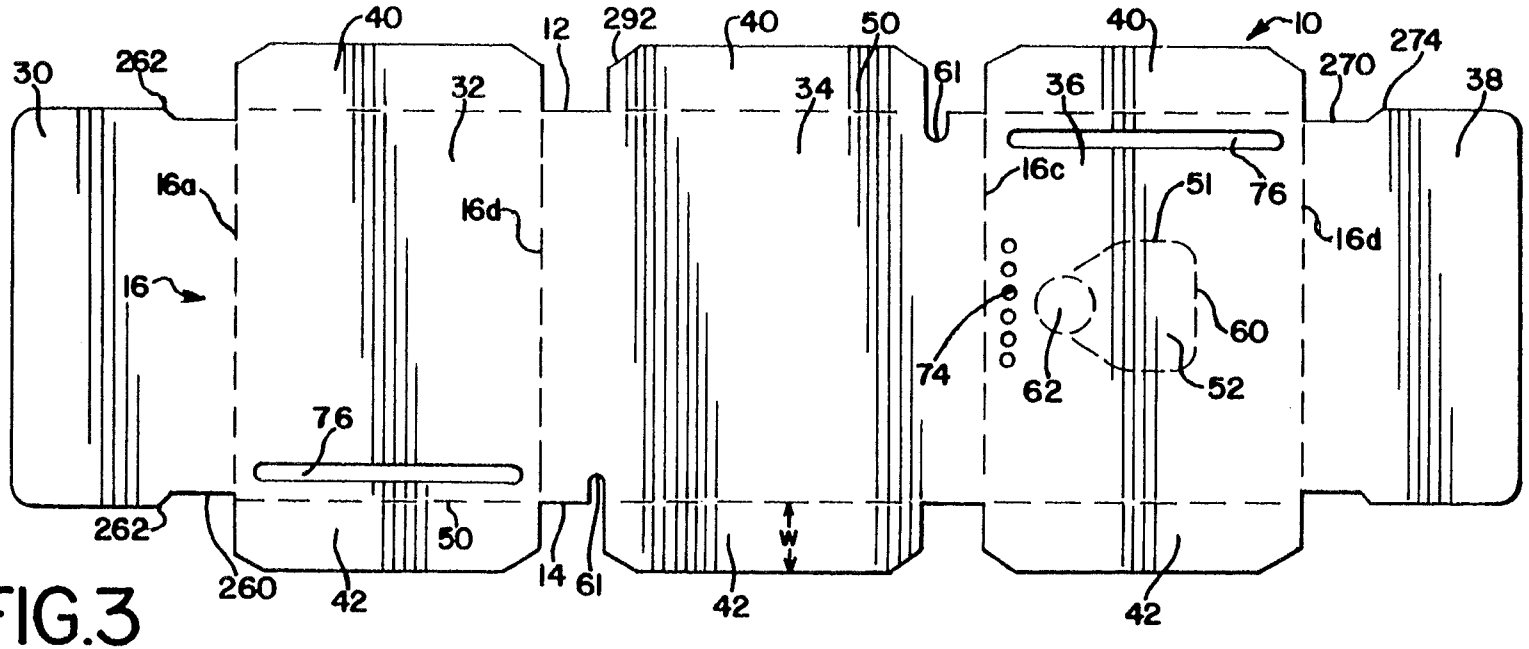
FIG. 3 is a top view of an elongate body blank of the present invention.

FIG. 3 shows an elongate body blank 10 having first and second lateral sides 12 and 14. Transverse fold lines 16*a–d* extend between the first and second lateral sides 12 and 14 to define a first, a second, a third, a fourth, and a fifth panel 30, 32, 34, 36, and 38. The body blank 10 may be folded along the transverse fold lines 16*a–d* to form a rectangular hoop.

Body flanges 40 extend from the first lateral side 12 of the body blank 10 at the second, third, and fourth panels, 32, 34, and 36, and body flanges 42 extend from the second lateral side 14 of the body blank 10 at the second, third, and fourth panels, 32, 34, and 36. (Although, it is contemplated that one may gain substantial structural support having flanges only along the second, and fourth panels as seen in FIGS. 5 through 7, it is preferable to have flanges along the second, third, and fourth panels). Marginal fold lines 50 separate the body flanges 40 and 42 from the body blank 10.

Notches 61 are removed from the third panel 34 at opposite lateral sides 12 and 14 of the body blank 10. The fourth panel 36 has perforations 51 that define a door 52 that is connected to the body blank 10 with a hinge section 60. The door 52 may be detached from the body blank 10 along the perforations 51 for pivotal movement. A perforated section 62 at a distal end of the door 52 is essentially circular in shape and is completely detachable from the door 52 to form a circular hole. The hole should have a diameter large enough to accommodate spouts commonly used on five gallon plastic liquid bags in the soft drink industry.

A plurality of horizontally spaced perforations 74 extend along the transverse fold line 16*c* between the fold line 16*c* and the distal end of the door 52. The perforations 74 are approximately 1/32 inch in diameter and are spaced $\frac{1}{8}$ inch apart and are preferably located $\frac{5}{8}$ inch from the distal end 62 of the door 52. These perforations 74 are provided to inhibit any tears in the panel 36 along the corrugations of the paperboard. The corrugations (not shown) run lengthwise along the body blank 10. The perforations 74 dissipate the tear in a direction essentially perpendicular to the direction of the tear.

The fourth panel 36 also has a portion removed along the body flange 42 to form an elongate positioning slot 76. Preferably, a second positioning slot 76 is located on the second panel 32 along the opposite side of the body blank 10 along the body flange 40.

Figure 4:
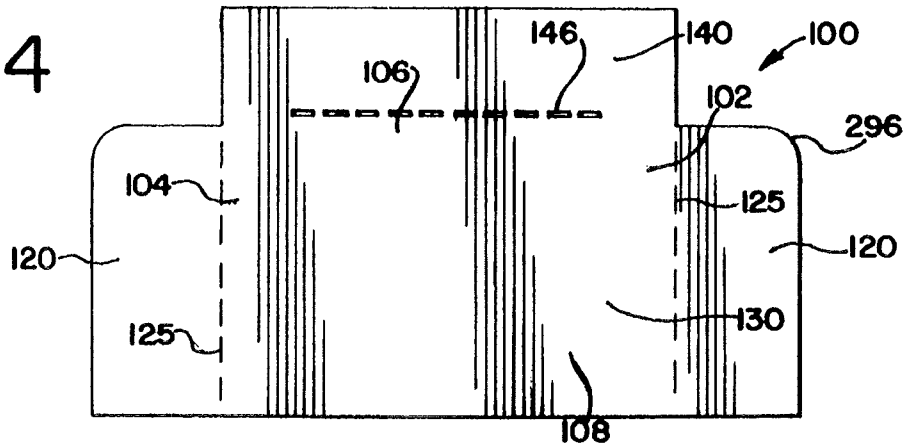
FIG. 4 is a top view of a side blank of the present invention.

FIG. 4 shows a side blank 100 having first and second opposed lateral sides 102 and 104, and a top and bottom end 106 and 108. Side flanges 120 extend from each lateral side 102 and 104 of the side blank 100. Marginal fold lines 125 separate the side flanges 120 from a side panel 130.

A top flange 140 extends from the side panel 130 from the top end 106 of the side blank 100. The top flange 140 is hingedly connected to the side blank 100 along a fold line 142. Preferably the fold line 142 is formed by a continuous score (not shown) on one side of the side blank 100 and by cutting a series of horizontally spaced perforations 146 $\frac{3}{8}$ inch long and $\frac{1}{4}$ inch apart along the same fold line 142 but on the opposite side of the side blank 100. This will enhance the foldability of the top flange 140.

The body blank 10 and two of the side blanks 100 may be attached together, as discussed in greater detail below, to form a box. This three piece construction allows one to use different material for the body blank 10 and the side blanks 100. Preferably, the body blank 10 is made of a single ply corrugated paper having the paperboard corrugations running longitudinally along the body blank 10, and the side blanks 100 are made of double ply corrugated paper. It is contemplated however that the paperboard corrugations in the body blank 10 could run latitudinally without any detriment to the structural integrity of the box to be formed from the blanks.

Figure 2:
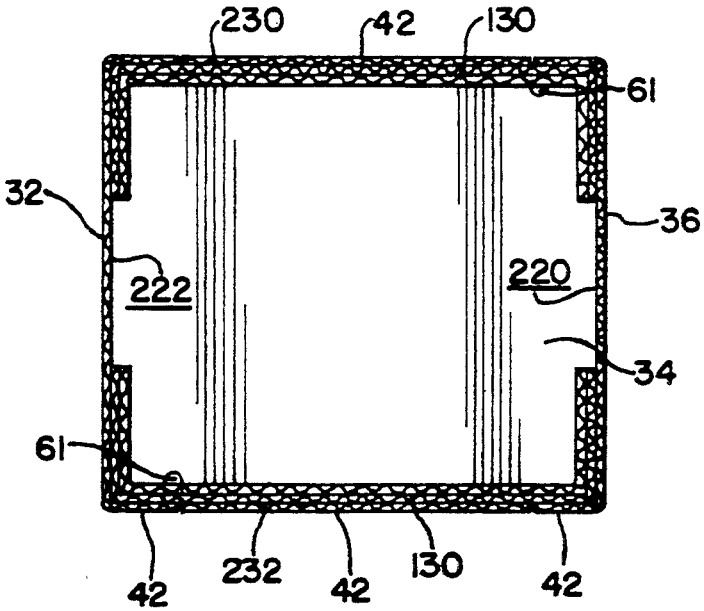
FIG. 2 is a top view of the box taken along line 2—2 of FIG. 1.

FIGS. 1 and 2 show the preferred embodiment of the box 200 made from the body blank 10 and two side blanks 100. To construct the box 200, the body blank 10 is folded along the transverse fold lines 16*a–d* so that the second panel 32 will serve as a second end wall 32 (the corresponding body panel and wall will be referred to with the same number designation), the third panel 34 serves as a bottom wall 34, and the fourth panel 36 serves as a first end wall 36. Two side blanks 100 are attached to the body blank 10, one at each opposite lateral side 12 and 14 of the body blank 10 such that the two side panels 130 serve as side walls 130. The sides of the side blanks 100 on which the continuous score (not shown) is cut to form the fold line 142 should face the interior of the box 200. The side blanks 100 are attached to the body blank 10 using the first and second body flanges 40 and 42 and the side flanges 120. One side blank 100 is inserted between the first and second end walls 36 and 32 along the first lateral side 12 of the body blank 10, and the side flange 120 extending from the first lateral side 102 of the side blank 100 attaches to an inner surface 220 of the first end wall 36 such that the side flange 120 covers the positioning slot 76. This prevents any external hazard from entering the box 200 through the positioning slot 76 and maintains the structural integrity of the box 200.

The side flange 120 extending from the second lateral side 104 of the side blank 100 attaches to an inner surface 222 of the second end wall 32. The body flanges 40 are folded along the marginal fold line 50 of the body blank 10 and attach to an outer surface 230 of the side wall 130. (The body flanges 40 and 42 that extend from opposite lateral sides 12 and 14 of the body blank 10 at the third panel 34 or bottom wall 34 are sometimes referred to as bottom flanges 40 and 42).

Similarly, on the second lateral side 14, of the body blank 10, the second side blank 100 is inserted between the first and second end walls 36 and 32. The side flange 120 extending from the first lateral side 102 of the side blank 100 attaches to the inner surface 220 of the first end wall 36, and the side flange 120 extending from the second lateral side 104 of the side blank 100 attaches to an inner surface 222 of the second end wall 32. The side flange which extends from the second lateral side 104 and attaches to the surface 222 covers the positioning slot 76 on the end wall 30. The body flanges 42 are folded along the marginal fold line 50 of the body blank 10 and attach to an outer surface 230 of the side wall 130.

The side flanges 120 act as a buffer, preventing a liquid filled bag from coming into contact with the end wall 36 and breaking-out the perforated door 52.

The box 200 is shown open; however, the box 200 may be closed by folding the top flanges 140 of each side wall 106 inwardly followed by folding the first and fifth panels 38, and 30 (the first and fifth panels 38 and 30 are sometimes referred to as the first and second top panels) inwardly toward one another along the transverse fold lines 16*a* and 16*d* over the top flanges 140 to cooperatively form a top wall of the box 200.

The perforated door 52 may be cut out of the end walls 32 or 36 or out of the side walls 130. However, it is preferable to cut the perforations 51 in the end walls 32 or 36 rather than the side walls 130 because the end walls 32 and 36 are formed from single ply corrugated paper that is much more easily cut, and may be more easily detached from the end wall than from the double ply corrugated paper that makes up the side walls 130. Further, the perforations 51 as disclosed are located in a portion of the end wall 36 that contributes less to the structural stability of the box 200 than if cut from the side wall 130. Accordingly, the box 200 has greater structural stability if the perforations 51 are made in the end walls 32 or 36 than if made in the side walls 130.

The horizontally spaced perforations 74 are located between the distal end of the door 52 and the bottom wall 34. The perforations 74 should extend at least the width of the door 52. The perforations 74 may be on a interior or exterior side of the box 200, but for esthetic purpose, the perforations are preferably located in the interior of the box.

Preferably the side flanges 120 and the body flanges 40 and 42 will be attached to the side wall or end walls using glue, although other methods could be used such as staples, or other adhesives and epoxies to accomplish the desired goal. The present invention further contemplates attaching the side flanges 120 to an outer surface of the first and second end walls 36 and 32 and having the body flanges 40 and 42 attaching to an inner surface of the side walls 130, or any combination of attachments that may be achieved using the disclosed body blank 10 and side blank 100.

The body flanges 40 and 42 and the side flanges 120 increase the thickness of edges 223 formed between the abutment of the end walls 36 and 32 with the side walls 130 and edges 226 formed between the side walls 130 and the bottom walls 34 forming essentially L-shaped support posts along the edges 223 and 226 and greatly increasing the axial and lateral stacking strength of the box 200. The L-shaped posts also prevent the box from breaking apart when a liquid filled bag is loaded into the box 200. The bottom flanges 40 and 42 in conjunction with the top flanges 140 increase the lateral stacking strength of the box 200. The increased stacking strength greatly reduces the chance of creasing any edges 223 or of the box 200 and prevents the door 52 from breaking out even when many filled boxes are stacked on one another or under the weight of a palletized load.

Preferably the side flanges 120 extend from the bottom wall 34 and terminate short of the first and fifth panels 30 and 38 by an amount $\alpha$ equal to the thickness of the side blank 100 so that a top portion 252 of the side flanges 120 may act as a stop for the top flanges 140. In other words, the side flanges 120 have a height lower than a height of the first and second end walls 36 and 32 by $\alpha$. This will facilitate the closing of the box 200 and provide for a flat top wall. To close the box 200, the top flanges 140 of both side blanks 100 are folded toward one another inwardly until an inner surface 250 of the top flanges 140 abuts the top end surface 252 of each of the side flanges 120. Accordingly, an outer surface 254 of the top flanges 140 are flush with a top 256 of the end walls 32 and 36 forming a firm, flat surface upon which the first and fifth panels 30 and 38 may be folded, and glued.

It is also desirable to provide a recess 260 on the first and second lateral edges 12 and 14 of the body blank 10 on the first panel 30. The recess 260 starts proximate the transverse fold line 16a and terminates at an intermediate portion 262 of the first panel 30 on each of the first and second lateral sides 12 and 14 of the body blank 10.

Similarly, a recess 270 extends along the first and second lateral edges 12 and 14 of the body blank 10 on the fifth panel 38. The recess 270 starts proximate the transverse fold line 16*d* and terminates at an intermediate point 272 along the first and second lateral edges 12 and 14 of the body blank 10. Both recesses 260 and 270 extend along the first and second lateral edges 12 and 14 of the body blank 10 for a least a distance W equal to a width of the body flanges 40 and 42. This allows the panels 30 and 38, to be folded down onto a flush surface provided in part by the top surface 254 of the top flanges 140, without abutting a top surface 280 of the body flanges 40 and 42.

The notches 61 cut from the bottom wall 34 act as holes to allow for the passage of air and liquid. These holes 61 will allow for a filled five gallon bag of liquid to displace the air within the box allowing the liquid in the bag to conform to the bottom wall 34 of the box 200. Also the holes 61 allow for early leak detection.

Finally, it is preferable that the top surface 252 of the side flanges 120 should have a rounded edge 296 and all the outer edges 298 of the top flanges 140, the side flanges 120, and the body flanges 40 and 42 should be cut with a serrated rule and the outermost ¼ inch be pressed nearly flat to blunt the edges 298 to prevent damaging the contents of the box 200. Also, each of the body flanges 40 and 42 have opposite ends with flange notches 292 at each end.

FIGS. 5 through 7 show another embodiment of the present invention without bottom flanges. Otherwise, this embodiment is the same as the one discussed above and shown in FIGS. 1 through 4.

While the specific embodiments have been illustrated and described, numerous modifications come to mind without significantly departing from the spirit of the invention and the scope of protection is only limited by the scope of the accompanying

We claim:

1. A system for forming a six wall box comprising:

an elongate body blank having transverse fold lines defining sequential first, second, third, fourth, and fifth panels, each of the panels having opposed lateral sides, and the second and fourth panels having a positioning slot;

a plurality of body flanges, one flange extending from each of the lateral sides of the second, and fourth panels, each of the body flanges having a width; and two side blanks, each of the side blanks having opposed lateral sides, opposed top and bottom ends, and a thickness, each of the side blanks further including a pair of side flanges, one of each of the side flanges extending from each of the lateral sides of the first and second side, blanks, the side flanges terminate short of the top end of the side blanks by a distance.

2. The system of claim 1 wherein the side blanks include a top flange extending from the top end of each of the side blanks wherein the distance is substantially equal to the thickness of each of the side blanks.

3. The system of claim 1 wherein the side flanges extend from the bottom end of the side blanks.

4. The system of claim 3 wherein the third panel also includes a pair of body flanges, one flange extending from each of the lateral sides of the third panel.

5. The system of claim 4 wherein the body flanges have opposed ends including:

flange notches at opposite ends.

6. The system of claim 5 wherein the first body panel and fifth body panel have portions removed along each of the lateral sides to define a pair of opposed recesses on the first and fifth panels, each of the recesses starting on the lateral sides of the second and fourth panels and terminating at an intermediate portion of the first and fifth panels.

7. The system of claim 6 wherein each of the recesses has a length at least as long as the width of the body flanges.

8. The system of claim 7 wherein the body flanges and the side flanges have serrated outer edges.

9. The system of claim 8 wherein the side flanges and the body flanges have flattened outer edges.

10. The system of claim 9 wherein the body blank is made of single ply corrugated paperboard, and the side blanks are made of double ply corrugated paperboard.

11. The system of claim 4 wherein one of the second and fourth panels has a door and a plurality of spaced perforations.

12. The system of claim 11 wherein the door has a detachable section and the perforations are horizontally spaced.

13. The system of claim 12 wherein the detachable section is substantially circular.

14. The system of claim 13 wherein the detachable section is located at a distal end of the door.

15. The system of claim 11 wherein the door is located centrally on one of the second and fourth panels and the perforations are located adjacent to the door and are 1/32 inch in diameter, ⅛ inch apart, and at least ⅝ inch from the distal end of the door.

16. The system of claim 4, wherein the third panel includes a hole.

17. The system of claim 16 wherein the hole is located along one of the lateral sides of the third panel.

18. A box comprising:

a bottom wall;

a first end wall attached to the bottom wall, the first end wall having a top end and a positioning slot;

a first top panel extending from the top end of the first end wall;

a second end wall attached to the bottom wall opposite the first end wall, the second end wall having a top end and a positioning slot;

a second top panel extending from the top end of the second end wall, the first and second top panels cooperatively form a top wall of the box;

a first side wall having a thickness;

a second side wall opposite the first side wall having a thickness;

the bottom wall, the first and second end walls, and the first and second side walls each of the side walls have opposed first and second lateral edges;

a first set of body flanges, one body flange extending from each of the first and second end wall first lateral edges, each of the body flange of the first set of body flanges being attached to the first side wall;

a second set of body flanges, one body flange extending from each of the first and second end wall second lateral edges, each of the body flanges of the second set of body flanges being attached to the second side wall;

a first set of side flanges, one side flange extending from each of the first and second side wall first lateral edges, each of the side flanges of the first set of side flanges being attached to the first end wall, the first set of side flanges extend along the first end wall and terminate short of the first end wall top end by a distance; and, a second set of side flanges, one side flange extending from the first and second side wall second lateral edges, each of the second set of side flanges are attached to the second end wall, the second set of side flanges extend along the second end wall and terminate short of the second end wall top end by a distance.

19. The box of claim 18 wherein the first and second set of body flanges and first and second bottom flanges attach to respective of said outer surfaces of each of the first and second side walls.

20. The box of claim 19 wherein the first and second set of side flanges attach to respective of said inner surfaces of each of the first and second end walls.

21. The box of claim 20 wherein each of the first and second side walls have a top flange extending from a top end of each of the first and second side walls wherein the distance is equal to the thickness of the first and second side walls.

22. The box of claim 21 including:

a first bottom flange extending from the bottom wall first lateral edge, the first bottom flange being attached to the first side wall; and, a second bottom flange extending from the bottom wall second lateral edge, the second bottom flange being attached to the second side wall.

23. The box of claim 22 wherein each of the first and second top panels have opposed lateral edges, each of the first and second top panel lateral edge has a portion removed to define a pair of opposed recesses, each of the recesses starting at the top end of the respective of said first and second end walls and terminate at an intermediate portion of the respective of said first and second top panels.

24. The box of claim 23 wherein each of the recesses has a length at least as long as the width of the body flanges.

25. The box of claim 22 wherein each of the body flanges extend from the bottom wall to the top end of the first and second side walls.

26. The box of claim 22 wherein each of the body flanges have opposed ends, the body flanges including: flange notches at each of the opposite ends.

27. The box of claim 22 wherein the bottom wall includes a hole.

28. The box of claim 27 wherein the hole is located along one of the lateral edges of the bottom wall.

29. The box of claim 22 wherein one of the first and second end walls includes a door and a plurality of spaced perforations.

30. The box of claim 29 wherein the door includes a detachable section and the perforations are located adjacent to the door.

31. The box of claim 30 wherein the detachable section is substantially circular.

32. The box of claim 31 wherein the detachable section is at a distal end of the door and the perforations are horizontally spaced.

33. The box of claim 30 wherein the door is centrally located on one of the first and second end walls and the perforations are 1/32 inch in diameter, $\frac{1}{8}$ inch apart, and at least $\frac{5}{8}$ inch from the distal end.

34. The box of claim 18 wherein each of the body flanges and each of the side flanges have serrated outer edges.

35. The box of claim 34 wherein each of the body flanges and each of the side flanges have flattened outer edges.

36. A box comprising:

a bottom wall having opposed ends;

a first and second end wall attached to the opposite ends of the bottom wall;

a first and second opposed side wall each of the walls having a thickness;

the bottom wall, the first and second end walls, and the first and second side walls each of the walls have opposed first and second lateral edges;

a first set of body flanges, one body flange extending from the first and second end wall's first lateral edges, each of the body flanges of the first set of body flanges being attached to the first side wall;

a second set of body flanges, one body flange extending from the first and second end wall's second lateral edges, each of the body flanges of the second set of body flanges being attached to the second side wall;

a first set of side flanges, one side flange extending from the first and second side wall's first lateral edges, each of the side flanges of the first set of side flanges being attached to the first end wall, the first set of side flanges extend along the first end wall and terminate short of the first end wall top end by a distance; and a second set of side flanges, one side flange extending from the first and second side wall second lateral edges, each of the second set of side flanges are attached to the second end wall, the second set of side flanges extend along the second end wall and terminate short of the second end wall top end by a distance; and, a top wall.

37. The box of claim 36 wherein the top wall is cooperatively formed from a first top panel extending from the first end wall and second top panel extending from the second end wall.

38. A method of making a six-sided box for containing a bag of liquid constructed comprising, in any order, the steps comprising:

providing a first blank including a plurality of contiguous panels, hingedly connected, having a thickness and a plurality of heights defined along an adjacent hinge; and, a plurality of flanges, hingedly connected;

providing a second blank including a first side panel hingedly connected to a first flap and a second plurality of flanges each of the flanges having a first height defined along an adjacent hinge;

providing a third blank including a second side panel hingedly connected to a second flap and a third plurality of flanges each of the flanges having a second height defined along an adjacent hinge;

attaching the first and second flaps to any one of the contiguous panels;

attaching the first and second plurality of flanges to an adjacent contiguous panel; and, forming a top wall by folding a contiguous panel on the end about an adjacent hinge, wherein the first height plus the thickness and the second height plus the thickness are substantially equal to the plurality of heights.

39. The method of claim 38 wherein the plurality of panels comprises first, second, third, fourth and fifth contiguous panels, wherein the second and fourth panels have a third height; the first and second flanges are hingedly connected to the second panel and third and fourth flanges are hingedly connected to the fourth panel; and a first perforated opening on any one (1) of the contiguous panels;

wherein the top wall is formed by attaching the first and fifth panels.

40. The method of claim 39 wherein the first blank further includes fifth and sixth flanges hingedly connected to the third panel, and wherein the perforated opening is on the fourth panel.

41. The method of claim 40 wherein any one (1) of the panels has one or more positioning slots.

42. The method of claim 41 wherein the second and fourth panels have a positioning slot.

43. A six-sided box made from the method of any one of claims 36 to 42.

44. A method of making a six-side box for containing a bag of liquid constructed, in any order of steps, by providing a first blank having first, second, third, fourth and fifth contiguous panels hingedly connected and having a thickness, wherein the second and fourth panels have a first height measured along the adjacent hinge; first and second flaps hingedly connected to two (2) of the contiguous panels; and a first perforated opening on one (1) of the contiguous panels;

providing a second blank having a sixth panel hingedly connected to a third flap and first and second flanges, wherein the third flap has a second height measured along the adjacent hinge;

providing a third blank having a seventh panel hingedly connected to a fourth flap and second and third flanges, wherein the fourth flap has a third height measured along the adjacent hinge;

attaching the third and fourth flaps to a contiguous panel;

folding the panels, flaps and flanges about the hinges; and, attaching the flaps to adjacent panels forming the six-sided box, wherein first height is approximately equal to both the second height plus the thickness and the third height plus the thickness.

* * * * *